US006824155B1

(12) United States Patent
Heck

(10) Patent No.: US 6,824,155 B1
(45) Date of Patent: Nov. 30, 2004

(54) AUXILIARY WHEEL SET FOR BOATS

(76) Inventor: Gordon Heck, 350 Hearst, Oxnard, CA (US) 93030

( * ) Notice: Subject to any disclaimer, the term of this patent is extended or adjusted under 35 U.S.C. 154(b) by 0 days.

(21) Appl. No.: 10/272,223

(22) Filed: Oct. 16, 2002

Related U.S. Application Data

(60) Provisional application No. 60/329,941, filed on Oct. 18, 2001.

(51) Int. Cl.[7] ..... B62D 63/00

(52) U.S. Cl. ..... 280/414.2; 114/344

(58) Field of Search ..... 114/344; 280/414.1, 280/414.2, 267

(56) References Cited

U.S. PATENT DOCUMENTS

| | | | | | |
|---|---|---|---|---|---|
| 2,410,570 | A | * | 11/1946 | Davis | 114/344 |
| 2,484,346 | A | * | 10/1949 | Iorns | 280/47.32 |
| 2,781,529 | A | * | 2/1957 | Moody | 114/344 |
| 2,916,747 | A | * | 12/1959 | Parrott | 114/344 |
| 3,134,111 | A | * | 5/1964 | Atwood | 114/344 |
| 3,616,474 | A | * | 11/1971 | Linbald | 114/344 |
| 3,697,096 | A | * | 10/1972 | Hadley | 280/47.32 |
| 3,931,211 | A | * | 1/1976 | Weber | 548/220 |
| 4,036,507 | A | * | 7/1977 | Henderson | 114/344 |
| 4,480,578 | A | * | 11/1984 | Fisher et al. | 114/344 |
| 4,567,844 | A | * | 2/1986 | Johnson | 114/344 |
| 4,706,983 | A | * | 11/1987 | Griswold | 280/414.2 |
| 6,394,017 | B2 | * | 5/2002 | Pavon et al. | 114/344 |
| RE37,855 | E | * | 9/2002 | Becht | 280/414.2 |

* cited by examiner

*Primary Examiner*—Lesley D. Morris
*Assistant Examiner*—Paul Royal, Jr.
(74) *Attorney, Agent, or Firm*—Roger A. Marrs

(57) ABSTRACT

A wheel set for boats attached to the transom has a first or non-operative position extending upwardly so as not to interfere with boat operation and a second or operative position where the wheel set is submerged below the surface of the water and makes rollable contact with the beach or land area beneath the boat. Supporting the wheel set is a base or rail fixed on the transom having a movable strut with one end supporting a wheel and the other end of slidably engaging with a track in the rail so that the strut is moved and pivoted from the non-operative position into the operative position. An open slot and pin arrangement is employed for holding one end of the strut in the non-operative position and an elongated closed slot and pin mechanism is provided for pivotally connecting the strut to the base or rail for pivoting into the operative position with the wheel downwardly depending from the boat, while another open slot and pin arrangement maintains the wheel in the operative position. An automatic alignment and maintenance of the wheel in the operative position includes having an air-filled tire which provides buoyancy so that the wheel will rise causing the pin of the arrangement to bear against the end of the slot holding the strut in place in a locking position.

4 Claims, 4 Drawing Sheets

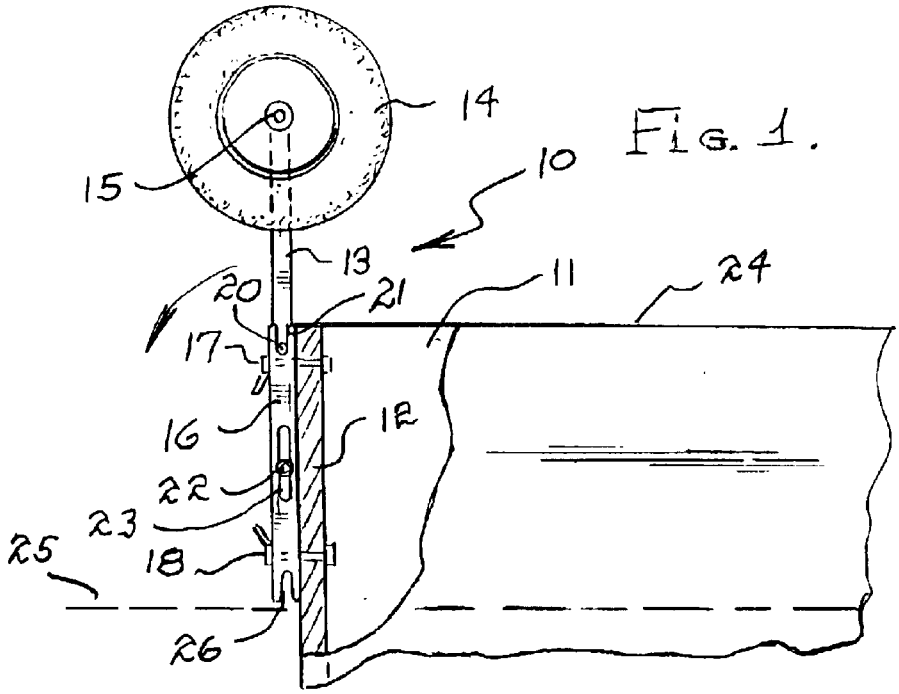
Fig. 1.
Fig. 2.
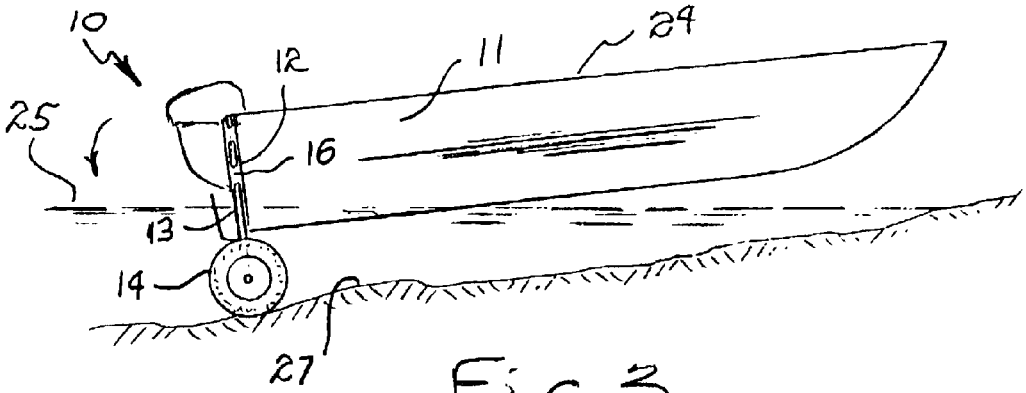
Fig. 3.
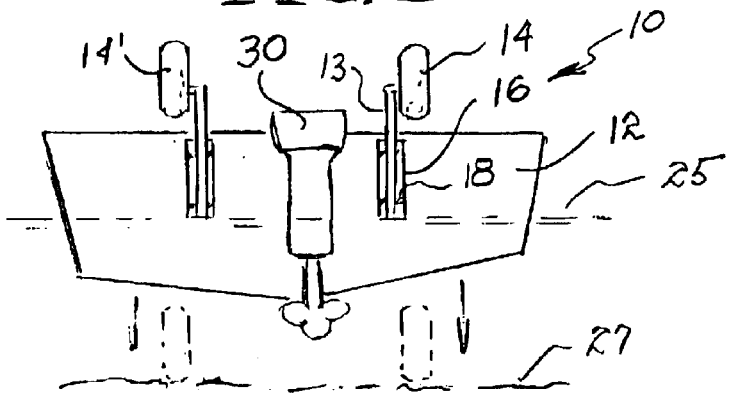

9
9
40
40
41
42
42
43
43
44
44
45
45
46
46
47
47
48
48
50
50
51
51

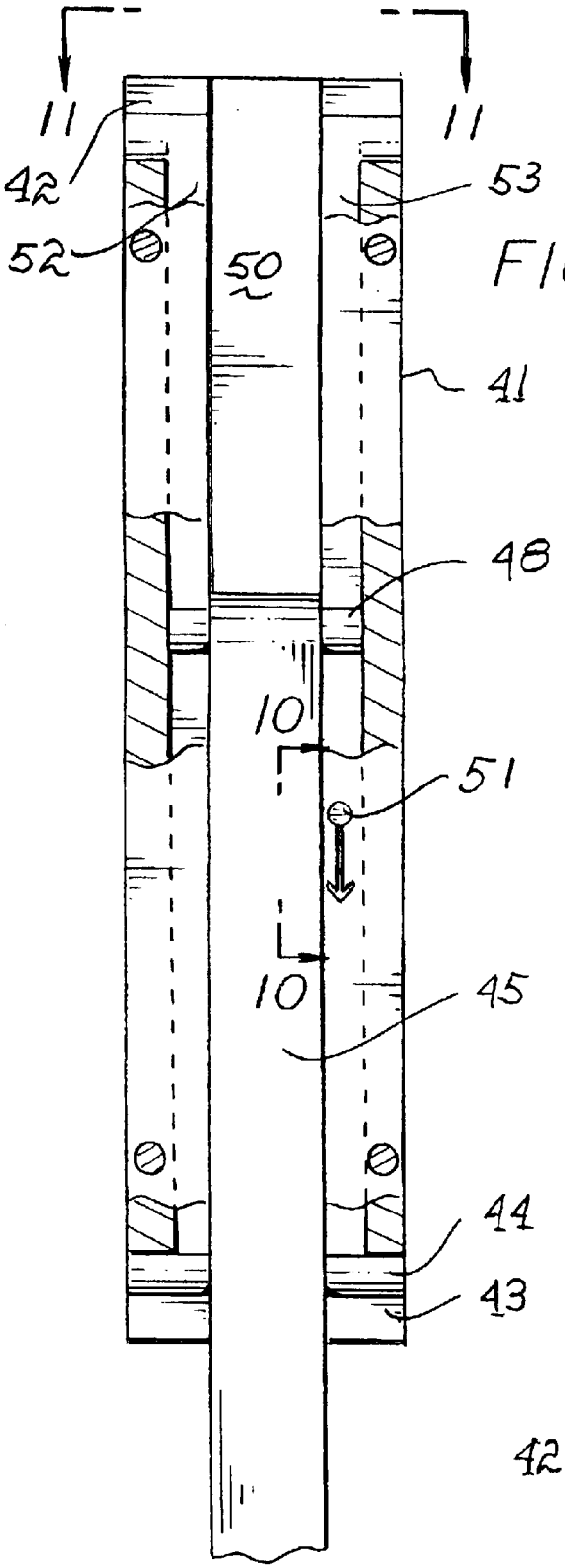
FIG. 9
FIG. 10
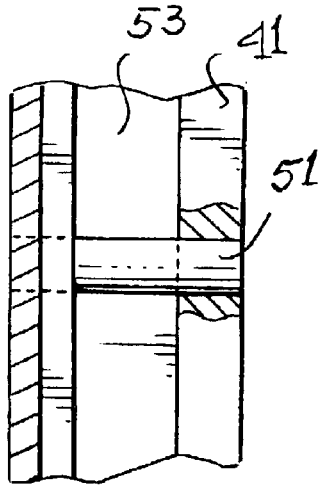
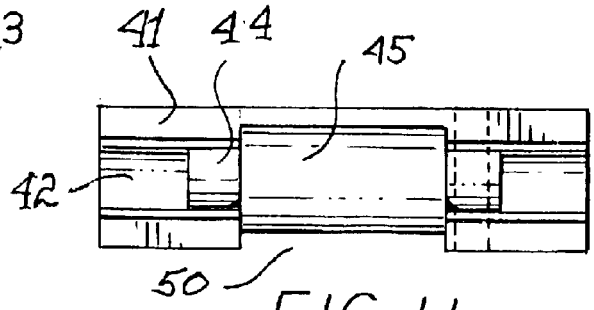
FIG. 11

AUXILIARY WHEEL SET FOR BOATS

Priority claimed on Ser. No. 60/329,941 filed Oct. 18, 2001

BACKGROUND OF THE INVENTION

1. Field of the Invention

The present invention relates to the field of boating equipment and more particularly to a novel wheel set mountable on the transom of a small boat that may be readily deployed into an operative position so as to rollably support the stern of the boat as it is withdrawn from the water's edge.

2. Brief Description of the Prior Art

In the past, difficulties and problems have been encountered when pulling a small boat away from the water's edge and onto a beach or landing area. The problems primarily stem from the fact that once the bow is out of the water, the stern must be dragged and pulled over sand, gravel, small rocks or the like until the entire boat is out of the water. Furthermore, as the boat approaches the landing area, one of the boaters generally jumps from the boat and grabs the bow so that the boat can be stabilized and pulling of the boat can be started. During this initial procedure, the stern is still floating and has a tendency to wobble or turn sideways as small incoming waves hit the transom of the boat and cause the boat to turn at an angle to the beach or landing area.

Therefore, a long-standing need has existed to provide a stabilizing means for supporting the stern of the boat as it is initially being beached and which means are useful for rollably supporting the stern of the boat as it is withdrawn from the water's edge. Such means should be carried on the stern of the boat in a non-operative position so as not to interfere with normal boat operation; however, preparatory for the beaching operation, the means should be deployable so that stabilization and support is provided as well as rollably supporting the stern of the boat.

SUMMARY OF THE INVENTION

Accordingly, the above problems and difficulties are avoided by the present invention which provides a novel wheel set for boats which is attached to the transom of a small boat and wherein the wheel set has a non-operative position extending upwardly so as not to interfere with boat operation. However, the wheel set is deployable into a second or operative position where the wheel set is submerged below the surface of the water and makes rollable contact with the beach or land area beneath the boat. The means for supporting the wheel set includes a base or rail fixed on the transom of the boat and further includes a movable strut having one end for supporting a wheel and the other end for slidably engaging with a track in the base so that the strut may be moved from the non-operative position into the operative position. Slot and pin means are employed for holding the strut in the non-operative position with respect to the base and an elongated slot and pin mechanism is provided on the base for connecting the strut in the operative position with the wheel downwardly depending from the boat. A feature resides in providing an automatic alignment of the pin and elongated slot which includes having an air-filled tire which provides buoyancy so that the wheel will rise causing the pin to move in the slot into a locking position.

Therefore, it is among the primary objects of the present invention to provide a novel set of wheels carried on the transom of a boat so that the wheels may be deployed into the water wherein buoyancy of the wheel will cause the wheels to engage in an operative position to rollably support the stern of a boat.

Another object of the present invention is to provide a novel rollable support for the stern of a boat which includes a set of wheels having a non-operative position out of the water and an operative position disposed beneath the water and further including an automatic engagement means based on the concept of the wheels being buoyant so as to rise in the water into a locking position.

Another object of the present invention is to provide a novel rollable means for stabilizing and rollably supporting the stern of a boat as it is being withdrawn through the surf for beaching or landing purposes.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a fragmentary view of the stern of a small boat illustrating one deployable wheel of a wheel set incorporating the present invention;

FIG. 2 is a reduced side-elevational view of the boat shown in FIG. 1 having the wheel set deployed into an operative position for rollably supporting the stern of the boat;

FIG. 3 is a rear elevational view of the boat shown in FIG. 2 illustrating the wheels in a non-operative position in solid lines and in a operative position in broken lines;

FIG. 9 is an enlarged rear view, partly in section, of the structural base of a selected one of the set, as taken in the direction of arrows 9—9 of FIG. 8;

FIG. 10 is a fragmentary view in section of a limit stop carried in the base, as taken in the direction of arrows 10—10 in FIG. 9; and FIG. 11 is a top plan view of the selected strut and base, as shown in FIG. 9, as taken in the direction of arrows 11—11 thereof.

DESCRIPTION OF PREFERRED EMBODIMENT

Figure 4:
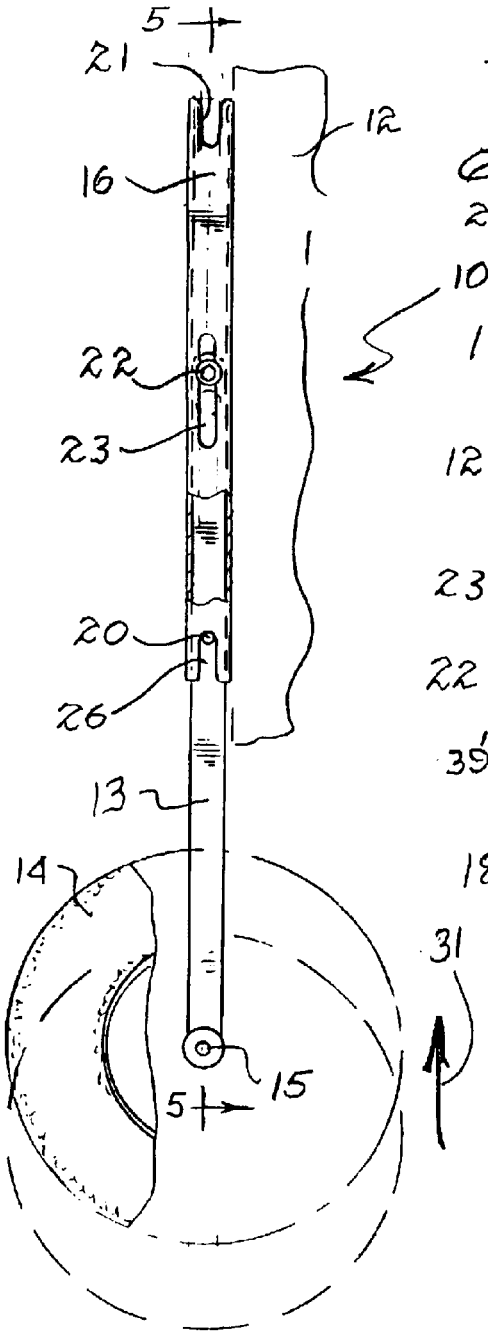
FIG. 4 is a side-elevational view of one of the wheels of the wheeled set incorporating the present invention.

Referring to FIG. 1, the inventive auxiliary wheel arrangement for boats is indicated in the general direction of arrow 10 wherein the stern of a boat is represented by numeral 11 which has a transom 12 for supporting the wheel set of the inventive arrangement. The wheel set comprises a pair of wheels wherein each wheel includes a strut 13 having a pneumatic wheel 14 carried on one end thereof by means of an axle 15. The opposite end of the strut 13 is slidably mounted in a base or rail 16 which is attached to the transom 12 by means of bolts 17 and 18 respectively. The wheel set is illustrated in the non-operative position where the wheel 14 is elevated above the rail of the boat 11 and the strut is held in the non-operative position by means of a stop pin 20 which is insertably received into an open slot 21. The strut 13 is maintained in the base 16 by means of a sliding or pivoting bolt 22 that is captured within a midsection closed-ended slot 23 provided in the side-members of base 16. Therefore, it can be seen that in the inoperative position the wheel set represented by the wheel shown in FIG. 1 is maintained in position by the stop pin 20 and pivot bolt 22 within the respective slots 21 and 23.

The rail of boat 11 is indicated by numeral. 24 while the level of water is indicated by numeral 25. It can also be seen that the opposite end of the base 16 from its end carrying open slot 21 is provided with a similar open slot 26 which is exposed above the water level 25. Therefore, it can be seen that the wheel set is fixly mounted to the outside of transom 12 and is in a position so that the strut 13 of each set can be raised upwardly to remove pin 20 from slot 21 but under control of the pivot bolt 22 within the slot 23 so that there is no separation between the strut 13 and the base 16.

Referring now in detail to FIG. 2, it can be seen that the strut 13 has now been pivoted from its non-operative position shown in FIG. 1 to an operative position wherein the strut has been pivoted, via pivot bolt 22, so that the wheel 14 enters the water below the surface level 25 and rests on the landing surface 27. In this position, the stop pin 20 carried on the strut has been removed from slot 21, and at the end of rotation in the direction of arrow 19, pin 20 is inserted into the open slot 26 so as to maintain the wheel 14 in the downwardly depending operative position as shown in FIG. 2. The strut is again supported on the base 16 by means of the bolt 22 as well as the pin 20 within the slot 26. A particular advantage of the invention resides in that the wheel 14 is buoyant so that when disposed under the surface level 25 of the water, buoyancy will cause the wheel to rise so as to insure and maintain insertion of pin 20 in the slot 26. This is an automatic operation and is permitted because of the elongation of slot 23 movably supporting the strut and the bolt 22.

Referring now to FIG. 3, it can be seen that the set of wheels is indicated by numerals 14 and 14' and that they are arranged in fixed, spaced-apart relationship so that an engine or motor 30 may be placed on the transom 12 in between the pair of wheels. The bases 16 of each set are fixly attached to the transom 12 and the wheel set is shown in solid lines in the non-operative position while the wheel set deployed into the operative position in broken lines and as rollably resting on the surface 27.

Referring now in detail to FIG. 4, it can be seen that the wheel 14 in solid lines is illustrated in the operative position wherein the strut downwardly depends from the base 16 and that the wheel 14 has been moved in the direction of arrow 31 due to the buoyancy experienced in the water. Buoyancy lifts or raises the wheel 14 from the position shown in broken lines to the position shown in solid lines so as to maintain the pin 20 within the slot 26. Furthermore, stability is achieved by permitting the bolt 22 to slide upwardly within the slot 23 from the position shown in broken lines to the position shown in solid lines. Therefore, the upper end of the strut 13 is stabilized within the base 16 and yet it is permitted to move rectilinearly within an elongated passageway or channel of the base, as indicated by numeral 29 in FIG. 5.

Figure 5:
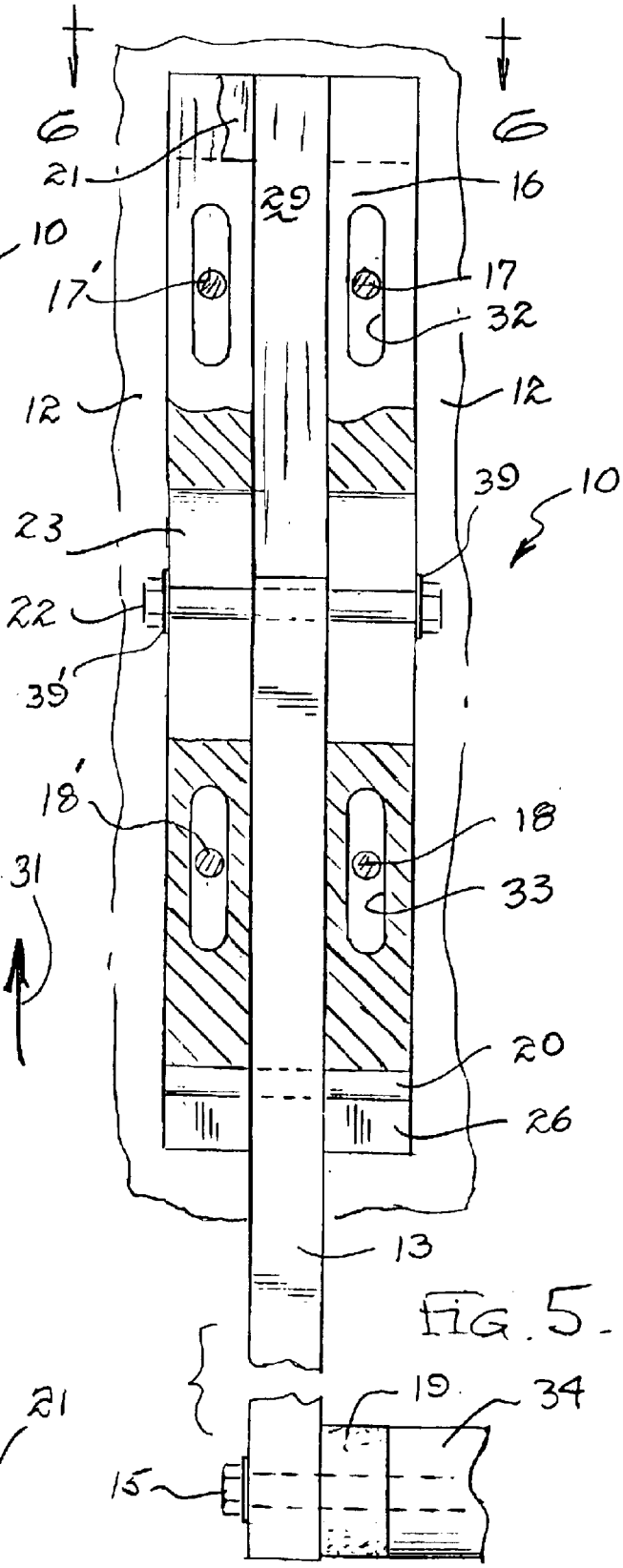
FIG. 5 is a rear view of one of the wheels of the wheel set, partially in cross-sectional view, as mounted on the transom of a boat.

Referring now in detail to FIG. 5, it can be seen that the base 16 is mounted to the transom 12 by a set of bolts 17 and 17' and 18 and 18'. These bolts are placed through elongated slots, such as slots 32 and 33, and the slots are elongated so as to permit selected location of the base on the transom 12 in an up and down direction with respect to the waterline. Adjustment can be made in a vertical direction so that the bolts 17 and 17' and 18 and 18' can be properly placed and tightened to hold the base in a desired position. The same construction is true for the lower set of bolts indicated by numerals 18 and 18' with respect to slots such as indicated by numeral 33. The pin 20 carried on the strut 13 is within slot 26 and bears against the end of the slot at the underside of the base 16. The pivot and movable bolt 22 fixly carried on the end of strut 13 has opposite ends disposed within the slot 23. It is noted that the ends of the slot 23 are closed so that the bolt, retained by washers 39 and 39', can only move between the closed ends of the slot and that the end of strut 13 is pivoted on the bolt 22 out of passageway or channel 29 when the wheel set is moved from the non-operative position to the operative position. The axle 15 passes through the lower end of the strut 13 and includes a washer or bearing 19 as well as a hub 34 on which the wheel is carried.

Figure 6:
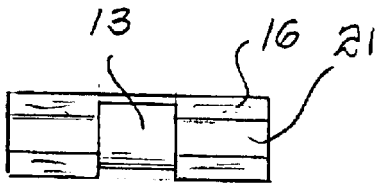
FIG. 6 is a top view of the wheel mount shown in FIG. 5 as taken in the direction of arrow 6—6 of FIG. 5.

In FIG. 6, it can be seen that the slot 21 is open at the top in order to receive the pin 20 when the wheel and strut are in the non-operative position.

In view of the foregoing, it can be seen that the auxiliary wheel set of the present invention provides a means for rollably supporting the stern of a boat as the boat is withdrawn through the surf onto the beach or landing area. As shown in FIG. 1, the wheel set is carried on the transom of the boat and is readily deployable into a lowered position beneath the boat at the stern. The wheel set is balanced since the wheels 14 and 14' are separated in fixed, spaced-apart relationship and both wheels engage the ground surface 27 upon which the wheels will roll. The boat can also be returned into the water by entering the water transom first so that the wheels will roll on the surface 27 until the boat is fully floated. At this time, the strut may be deployed by removing the pin 20 from slot 26 and each strut of the wheel set can be rotated on the respective bolts 22 upwardly to the non-operative position where the pin 20 is then inserted into the upwardly open-ended slot 21. At all times during the deployment of the wheels when in the water, buoyancy will normally cause the wheels to raise towards the surface. This action is taken advantage of during deployment of the wheel set into the water for engagement with the surface 27. Buoyancy will cause the wheel set to rise so that the strut, under guidance, goes into the base 16 and pin 20 will enter slot 26.

Figures 7, 8:
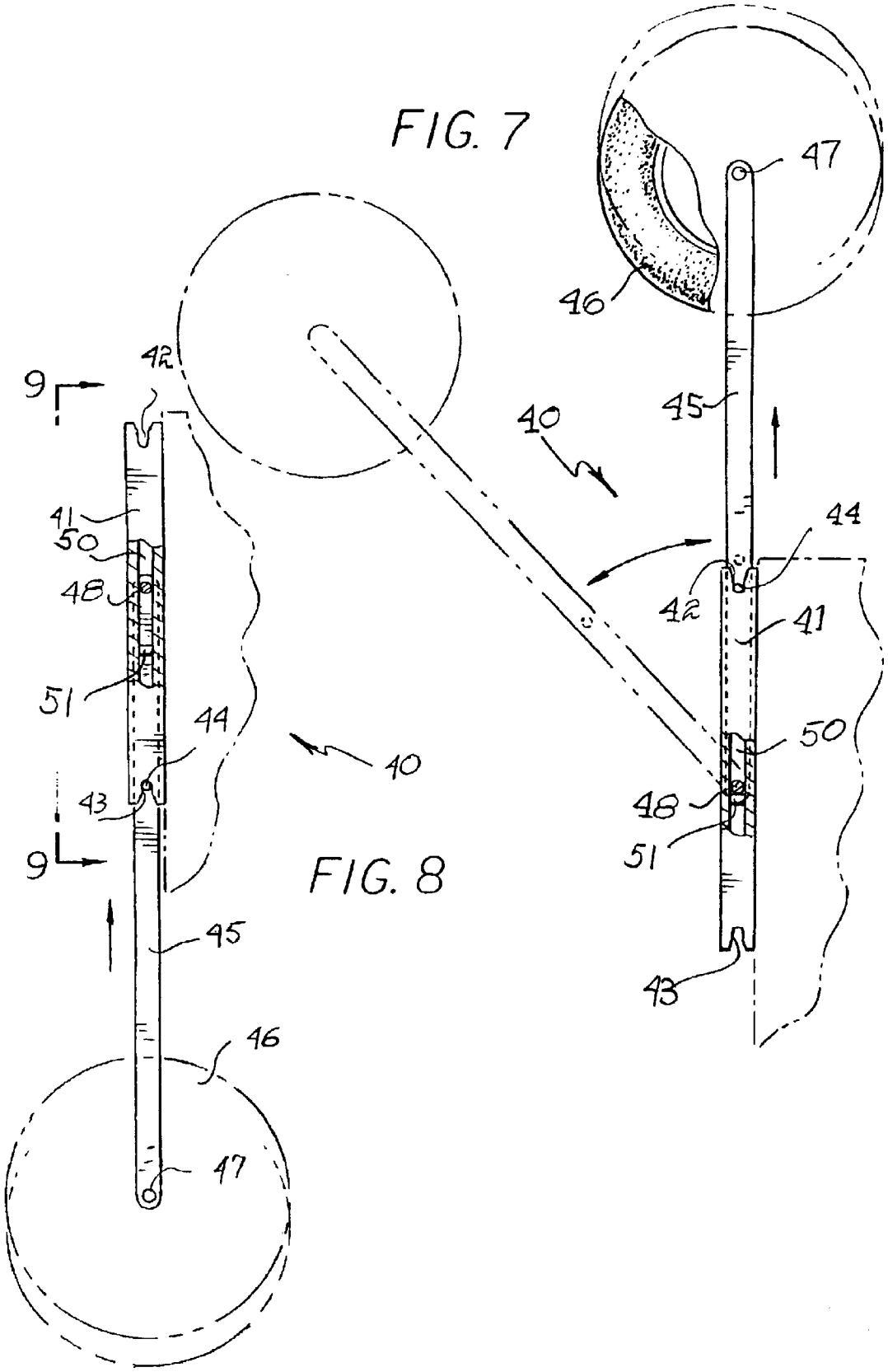
FIG. 7 is a side elevational view of another embodiment of the present invention showing the wheel set in its operative position.
FIG. 8 is a view, similar to the view of FIG. 7, illustrating the wheel set in its inoperative position preparatory for deployment into its operative position.

Referring to FIGS. 7 and 8, another version of the present invention is illustrated wherein FIG. 7 illustrates the wheel 46 of the wheel set in the non-operative position carried on the transom of a boat. The wheel 46 is attached to one end of a strut 45 by an axle 47 while the strut is carried on a base 41. Opposite ends of the base are provided with slots 42 and 43 that are open and it is to be particularly noted that the openings are tapered in order to provide a wide entrance into the slot serving as a guide for accepting a position pin 44 into the slot. The pin 44 is carried on the midsection of strut 45 and is illustrated as being in slot 42 when the wheel 46 is in its raised non-operative position, as shown in FIG. 7. However, when moved from the non-operative position shown in solid lines to the operative position, the strut 45 is raised upwardly to remove pin 44 from slot 42 whereby the strut 45 is pivoted on a pivot pin 48 to the position shown in broken lines. It is to be noted that the opposite ends of the pivot pin 48 slidably reside in open channels which are in opposition to one another and separated by a central elongated slot in the body 41. Such a mechanism will be described later with respect to FIGS. 9 and 10.

With respect to FIG. 8, the strut 45 with wheel 46 has been deployed into the operative position and buoyancy of the wheel 46 in the water will cause the strut to rise within its slot or channel and when properly guided, pin 44 will be introduced to slot 43. The extra-wide mouth or tapered opening leading into the slot 43 will assist in positioning the pin 44 deep into the slot until it bottoms out at the end of the slot. It can be seen further in FIG. 8 that a limit stop pin 51 is included with the base 41 to prevent the pivot pin 48 from falling through the passageway or channel in the base 41. However, if it is desired to remove the strut from the base, the strut can be moved upwardly until the pivot 48 clears the end of the base and with removal of the wheel 46 and axle 47, the strut can be removed. This is achieved for service and maintenance purposes only and is not part of operating procedure between the operative or non-operative position.

Referring now to FIG. 9, it can be seen that the opposite ends of slider pivot pin 48 carried on the end of strut 45 resides within channels or tracks 52 and 53 of the main passageway or channel 50. The base 41 includes flanges which define the channels or tracks 52 and 53 with respect to the back plate of the base. Therefore, as clearly shown in the fragmentary or sectional portion of the drawing, pin 48 can slide in and out of the base 41 and be controlled by the flanges and base plate of the base 41. It is to be understood that the position pin 44 is fixed and is not a pivot pin, and that the pin 44 serves as an abutting pin for engaging with the end of the slots 42 and 43 respectively depending on whether the strut is in its operative or non-operative position. As illustrated in FIGS. 9 and 10, the limit stop pin 51 prevents the pin 48 on the end of the strut from leaving the main passageway 50 when the strut and wheel are in the down position. However, the device can be taken apart by causing the strut 45 to move upwardly in the passageway 50 until the pin 48 has left the base altogether, and after removal of the wheel and axle, the entire strut can be removed for service and maintenance purposes.

As shown in FIG. 11, the position pin 44 is in the upper slot or notch 42 with the opposite ends of the retaining pin 44 resting on the bottom of the slot. The opposite ends of pin 44 reside within the limits of the respective slots or notches 42 or 43 while the opposite ends of the pivot pin 48 resides within the opposing channel 52 and 53.

In view of the foregoing, it can be seen that the operation of the embodiment shown in FIGS. 7–11 is substantially identical to the operation of the embodiment shown in FIGS. 1–6.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An auxiliary two-component wheel arrangement for a boat comprising:

an elongated base having a central passageway terminating at an upper end of said base and at a lower end of said base;

a linear strut movably disposed in said passageway and having a pivot end and a wheel end rotatably carrying a pneumatic wheel;

said base having an open tapered upper notch at said upper end and an open tapered lower notch at said lower end;

a pivot pin fixedly secured to said pivot end of said strut and having outwardly extending opposite ends in slidable relationship with respect to said base;

said strut having a position pin outwardly projecting from opposite sides of said strut midway between said pivot end and said wheel end;

said strut movable laterally from said passageway about said pivot pin for inserting said position pin into either said upper notch or said lower notch;

said pneumatic wheel provides buoyancy when submerged to urge said strut into said passageway and to urge said position pin into said lower notch; and a limit stop pin fixedly secured on said base midway between said upper end and said lower end and crossing said passageway to prevent travel of said pivot pin towards said lower end of said base.

2. The arrangement defined in claim 1 wherein:

said passageway of said base is defined between a pair of channels forming tracks for retaining said opposite ends of said pivot pin on said base as said strut moves between an operative position and a non-operative position.

3. The arrangement defined in claim 2 wherein:

said limit stop pin being fixedly disposed across at selected one of said pair of channels defining said passageway.

4. The arrangement defined in claim 3 wherein:

said base and said strut solely comprise a two-component construction.

* * * * *